US009771885B2

(12) United States Patent
Takahashi et al.

(10) Patent No.: US 9,771,885 B2
(45) Date of Patent: Sep. 26, 2017

(54) ENGINE CONTROL APPARATUS

(71) Applicants: TOYOTA JIDOSHA KABUSHIKI KAISHA, Toyota-shi (JP); DENSO CORPORATION, Kariya-shi (JP)

(72) Inventors: Kiyonori Takahashi, Toyota (JP); Yoshiyasu Ito, Toyota (JP); Nobuyoshi Takigawa, Obu (JP)

(73) Assignees: TOYOTA JIDOSHA KABUSHIKI KAISHA, Toyota-shi (JP); DENSO CORPORATION, Kariya-shi (JP)

( * ) Notice: Subject to any disclaimer, the term of this patent is extended or adjusted under 35 U.S.C. 154(b) by 287 days.

(21) Appl. No.: 14/795,496

(22) Filed: Jul. 9, 2015

(65) Prior Publication Data

US 2016/0010579 A1 Jan. 14, 2016

(30) Foreign Application Priority Data

Jul. 10, 2014 (JP) ..... 2014-142360

(51) Int. Cl.
*F02D 41/00* (2006.01)
*F02D 41/26* (2006.01)
*F02D 41/22* (2006.01)

(52) U.S. Cl.
CPC ..... *F02D 41/26* (2013.01); *F02D 41/22* (2013.01); *F02D 2200/0614* (2013.01); *F02D 2200/101* (2013.01); *F02D 2250/12* (2013.01)

(58) Field of Classification Search
CPC ..... F02D 2250/12; F02D 41/22; F02D 41/26; F02D 2200/101; F02D 2200/0614
See application file for complete search history.

(56) References Cited

U.S. PATENT DOCUMENTS

| | | | | |
|---|---|---|---|---|
| 9,482,171 | B2 * | 11/2016 | Iwase | F02D 41/0085 |
| 9,664,096 | B2 * | 5/2017 | Morihiro | F01N 11/007 |
| 2011/0282541 | A1 * | 11/2011 | Kidokoro | F02D 41/0085 701/31.4 |
| 2012/0006307 | A1 * | 1/2012 | Demura | F02D 41/1454 123/674 |
| 2015/0073682 | A1 | 3/2015 | Ito | |

FOREIGN PATENT DOCUMENTS

| | | |
|---|---|---|
| JP | 01-218929 | 9/1989 |
| JP | 11-190247 | 7/1999 |
| JP | 2008-309077 | 12/2008 |
| JP | 2013-238203 | 11/2013 |

* cited by examiner

*Primary Examiner* — Thomas Moulis
(74) *Attorney, Agent, or Firm* — Oblon, McClelland, Maier & Neustadt, L.L.P.

(57) ABSTRACT

A control apparatus for an engine includes a control unit. The engine includes a sensor. The control unit determines whether or not an abnormality has occurred in a calculation function of the control unit on the basis of a comparison result between the control required injection amount and the monitoring required injection amount. The control unit determines whether or not an abnormality has occurred in the calculation function of the control unit without using the comparison result when the comparison result is calculated during a predetermined period. The predetermined period is a period of a delay that occurs between updating of one of respective values of the control rotation speed and the monitoring rotation speed and updating of the other value due to a difference between the first timing and the second timing.

4 Claims, 5 Drawing Sheets

ENGINE CONTROL APPARATUS

INCORPORATION BY REFERENCE

The disclosure of Japanese Patent Application No. 2014-142360, filed on Jul. 10, 2014 including the specification, drawings and abstract, is incorporated herein by reference in its entirety.

BACKGROUND OF THE INVENTION

1. Field of the Invention

The invention relates to an engine control apparatus, and more particularly to an improvement in a control structure used to monitor a calculation function of the engine control apparatus.

2. Description of Related Art

An apparatus described in Japanese Patent Application Publication No. 11-190247 (JP 11-190247 A) is available as a conventional engine control apparatus that performs the monitoring described above. The engine control apparatus described in JP 11-190247 A monitors an injector drive circuit for an abnormality by comparing an energization period during which the injector drive circuit actually energizes an injector and an energization period issued as a command to the injector drive circuit.

SUMMARY OF THE INVENTION

An abnormality that causes an inappropriate amount of fuel to be injected from the injector may occur due not only to a breakdown in the injector drive circuit but also to an abnormality in a calculation function of the engine control apparatus itself.

In consideration of these circumstances, the invention provides an engine control apparatus that is capable of favorably monitoring its own calculation function for an abnormality.

According to an aspect of the invention, a control apparatus for an engine includes a control unit. The engine includes a sensor. The control unit (10) is configured to calculate a control rotation speed from a detection result obtained by the sensor, and calculate a monitoring rotation speed from a detection result obtained by the sensor. The control unit (10) is configured to calculate a control required injection amount. The control required injection amount is a required injection amount used during actual fuel injection amount control. The control required injection amount is calculated on the basis of the control rotation speed. The control unit (10) is configured to calculate a monitoring required injection amount. The monitoring required injection amount is a required injection amount used during monitoring. The monitoring required injection amount is calculated on the basis of the monitoring rotation speed. The control unit (10) determines whether or not an abnormality has occurred in a calculation function of the control unit (10) on the basis of a comparison result between the control required injection amount and the monitoring required injection amount. The control unit (10) calculates the control rotation speed from a detection result obtained by the sensor at a first timing, and calculates the monitoring rotation speed from a detection result obtained by the sensor at a second timing that is different to the first timing. The control unit (10) determines whether or not an abnormality has occurred in the calculation function of the control unit (10) without using the comparison result when the comparison result is calculated during a predetermined period. The predetermined period is a period of a delay that occurs between updating of one of respective values of the control rotation speed and the monitoring rotation speed and updating of the other value due to a difference between the first timing and the second timing.

An abnormality may occur in the calculation function of the engine control apparatus such that an abnormal value is calculated as the required injection amount. At this time, however, the abnormality is unlikely to affect the respective required injection amounts used for the control and the monitoring, which are calculated individually using engine rotation speeds calculated from detection results obtained by the sensor at different timings, in a perfectly identical manner. When the abnormality occurs, therefore, a difference occurs between the respective values of the control required injection amount and the monitoring required injection amount. Accordingly, the presence of the abnormality can be determined on the basis of a comparison result between the respective values.

However, when the sensor detection timings used in the calculations are varied relative to each other, a time difference occurs between timings at which the respective values of the control rotation speed and the monitoring rotation speed are updated. As a result, a period exists in which one of the control rotation speed and the monitoring speed has been updated to a newest value but the other value has not yet been updated to a newest value. When the engine rotation speed varies, the control rotation speed and the monitoring rotation speed take different values within this period, leading to a difference between the respective values of the control required injection amount and the monitoring required injection amount calculated using the rotation speed values. In this case, therefore, an abnormality may be determined erroneously even though no abnormality exists.

Hence, in the engine control apparatus described above, when the control required injection amount and the monitoring required injection amount are calculated within the lag period between the respective update timings of the values of the control rotation speed and the monitoring rotation speed, the comparison result between the required injection amounts is not used to determine the presence of an abnormality, and therefore an erroneous determination such as that described above is suppressed. As a result, the engine control apparatus described above can favorably monitor its own calculation function for an abnormality.

Note that when crank angles are set as the respective timings at which detection results are obtained from the sensor for use during calculation of the control rotation speed and the monitoring rotation speed, the lag period described above may be checked on the basis of the crank angle.

Incidentally, the value of the control required injection amount is typically updated in each ignition cycle of the engine.

According to the aspect described above, the sensor may include a crank angle sensor (12). The control unit (10) may be configured to calculate the control rotation speed and the monitoring rotation speed in each ignition cycle of the engine from detection results obtained by the crank angle sensor respectively at the first timing and the second timing within the ignition cycle.

Incidentally, as long as the actual engine rotation speed does not vary during the update lag period, the comparison result between the control required injection amount and the monitoring required injection amount may be used without causing the erroneous determination described above even when the respective required injection amounts are calculated during the update lag period.

According to the aspect described above, the control unit (10) may be configured to use the comparison result between the control required injection amount calculated during the predetermined period and the monitoring required injection amount calculated during the predetermined period to determine whether or not an abnormality has occurred in the calculation function of the control unit (10) when the control rotation speed and the monitoring rotation speed match during the predetermined period.

According to the aspect described above, the control unit (10) may be configured to calculate the control required injection amount as fixed angle interrupt processing. The fixed angle interrupt processing is processing implemented when a crank angle of the engine reaches a prescribed angle. Further, the control unit (10) may be configured to calculate the monitoring required injection amount as fixed time interrupt processing. The fixed time interrupt processing is processing implemented every time a prescribed period elapses.

The calculation timing of the control required injection amount and the calculation timing of the monitoring required injection amount cannot be synchronized, and therefore erroneous detection of an abnormality due to a deviation between the acquisition timings of the sensor detection results is likely to occur. Even in this case, however, with the engine control apparatus described above, erroneous detection of an abnormality due to a deviation between the acquisition timings can be suppressed favorably. As a result, monitoring for detecting the presence of an abnormality can be implemented favorably.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
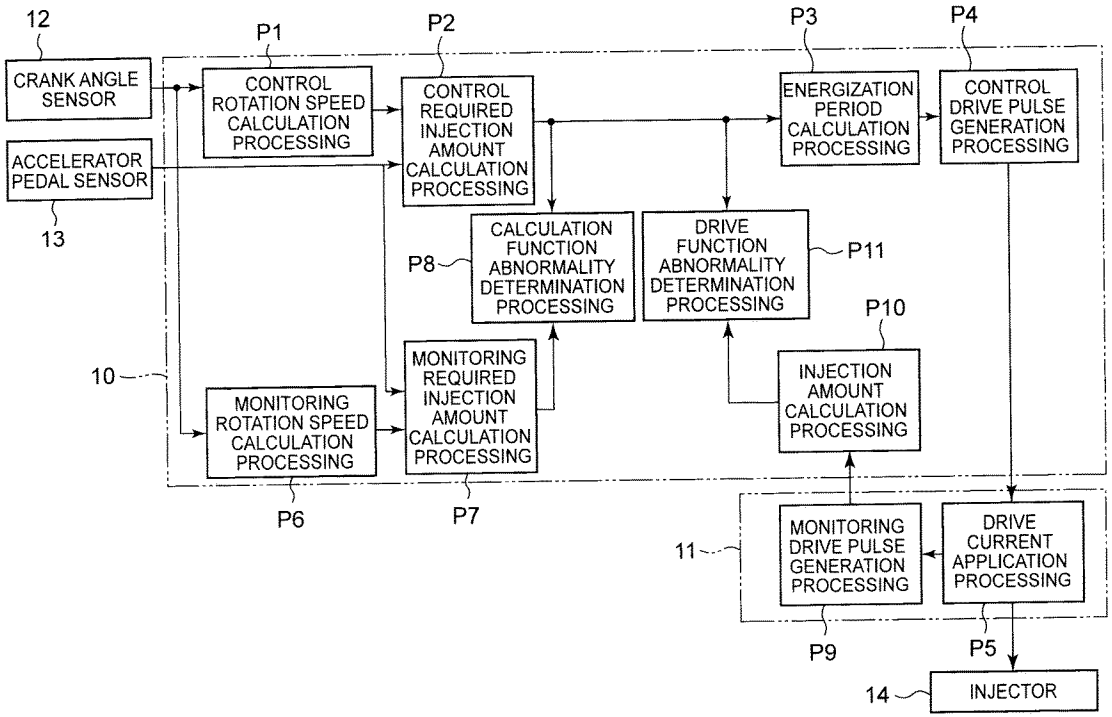
FIG. 1 is a schematic view showing a configuration of an embodiment of an engine control apparatus together with a control structure for performing fuel injection amount control and monitoring this control.

An embodiment of an engine control apparatus will be described in detail below with reference to FIGS. 1 to 6. As shown in FIG. 1, the engine control apparatus according to this embodiment includes a control unit 10 and an injector drive circuit 11.

The control unit 10 includes a central processing unit (CPU), which is a calculation processing apparatus that performs various types of calculation processing required for engine control, a read only memory (ROM), which is a read-only storage medium on which a program and data required for the engine control are stored, and a random access memory (RAM), which is a rewritable storage medium on which calculation results obtained by the CPU, detection results obtained by sensors, and so on are stored temporarily. Further, a timer is built into the control unit 10 so that a current time can be obtained.

A signal line on which to receive detection signals from sensors such as a crank angle sensor 12 that detects a rotary phase (a crank angle) of a crankshaft serving as an engine output shaft and an accelerator pedal sensor 13 that detects an accelerator pedal depression amount (an accelerator depression amount ACCP) is connected to the control unit 10. Further, an electric wire on which to transmit a drive current to respective injectors 14 of the engine is connected to the injector drive circuit 11.

The engine control apparatus according to this embodiment, configured as described above, controls an amount of fuel injected from the injector 14. The fuel injection amount control is performed through processing described below, which is implemented by the control unit 10 and the injector drive circuit 11.

The control unit 10 performs control rotation speed calculation processing P1 to calculate a current engine rotation speed from the detection signal of the crank angle sensor 12. Note that hereafter, the engine rotation speed calculated during the control rotation speed calculation processing P1 will be referred to as a control rotation speed NE1.

Further, the control unit 10 performs control required injection amount calculation processing P2 to calculate a required injection amount on the basis of the control rotation speed NE1 calculated during the control rotation speed calculation processing P1, the accelerator depression amount ACCP detected by the accelerator pedal sensor 13, and so on. The required injection amount calculated during the control required injection amount calculation processing P2 is a required value of the fuel injection amount used during actual fuel injection amount control, and will be referred to in the following description as a control required injection amount Q1.

Furthermore, the control unit 10 performs energization period calculation processing P3 to calculate an energization period in which a drive current required by the injector 14 to inject fuel in an amount corresponding to the control required injection amount Q1 calculated during the control required injection amount calculation processing P2 is applied to the injector 14. The control unit 10 also performs control drive pulse generation processing P4 to generate an injector drive pulse corresponding to the energization period calculated during the energization period calculation processing P3. The injector drive pulse is a pulse signal that rises when fuel injection starts and falls when fuel injection ends. The injector drive pulse generated during the control drive pulse generation processing P4 is output to the injector drive circuit 11.

The injector drive circuit 11, meanwhile, performs drive current application processing P5 to apply the drive current to the injector 14 in accordance with the injector drive pulse input therein from the control unit 10. As a result, the drive current required to inject fuel in an amount corresponding to the control required injection amount Q1 calculated by the control unit 10 is applied to the injector 14.

Incidentally, the control unit 10 executes the control rotation speed calculation processing P1, the control required injection amount calculation processing P2, the energization period calculation processing P3, and the control drive pulse generation processing P4 respectively as fixed angle interrupt processing, which is processing executed when the crank angle of the engine reaches a prescribed angle.

The engine control apparatus according to this embodiment monitors the fuel injection control executed through the processing described above to determine whether or not the fuel injection control is being performed normally. In this embodiment, the monitoring includes calculation function monitoring, which mainly involves monitoring a calculation function of the control unit 10 for an abnormality, and drive function monitoring, which mainly involves monitoring an injection drive pulse generation function of the control unit 10 and an injection drive current application function of the injector drive circuit 11 for an abnormality.

The control unit 10 performs monitoring rotation speed calculation processing P6, monitoring required injection amount calculation processing P7, and calculation function abnormality determination processing P8 as processing relating to the calculation function monitoring. In the monitoring rotation speed calculation processing P6, the control unit 10 calculates the current engine rotation speed from the detection signal of the crank angle sensor 12. The engine rotation speed calculated during the monitoring rotation speed calculation processing P6 will be referred to in the following description as a monitoring rotation speed NE2.

Further, in the monitoring rotation speed calculation processing P6, the engine rotation speed is calculated differently to the engine rotation speed calculated in the control rotation speed calculation processing P1. This difference will be described in detail below. Note that the control unit 10 executes the monitoring rotation speed calculation processing P6 as fixed angle interrupt processing.

Furthermore, in the monitoring required injection amount calculation processing P7, the control unit 10 calculates a required injection amount used during monitoring on the basis of the monitoring rotation speed NE2 calculated during the monitoring rotation speed calculation processing P6 and the accelerator depression amount ACCP detected by the accelerator pedal sensor 13. The required injection amount calculated during the monitoring required injection amount calculation processing P7 will be referred to in the following description as a monitoring required injection amount Q2. Note that the control unit 10 executes the monitoring required injection amount calculation processing P7 as fixed time interrupt processing, which is processing implemented every time a prescribed period elapses.

Incidentally, the control unit 10 outputs a signal indicating a value of the calculated monitoring required injection amount Q2 to an external monitoring apparatus every time the monitoring required injection amount calculation processing P7 is performed. The monitoring apparatus monitors the control unit 10, and determines whether or not the control unit 10 is operating normally according to whether or not this signal is input periodically without interruption.

Moreover, as the processing relating to the calculation function monitoring, the control unit 10 performs the calculation function abnormality determination processing P8 to determine whether or not an abnormality exists in the calculation function thereof from a result of a comparison between the monitoring required injection amount Q2 calculated during the monitoring required injection amount calculation processing P7 and the control required injection amount Q1 calculated during the control required injection amount calculation processing P2. The control unit 10 executes the calculation function abnormality determination processing P8 as fixed time interrupt processing.

Meanwhile, as processing relating to the drive function monitoring, the injector drive circuit 11 performs monitoring drive pulse generation processing P9 to generate a monitoring drive pulse that corresponds to a drive current application period. The monitoring drive pulse is generated in the form of a pulse signal that rises when application of the drive current to the injector 14 starts and falls when application of the drive current ends. The monitoring drive pulse generated during the monitoring drive pulse generation processing P9 is output to the control unit 10.

Further, as the processing relating to the drive function monitoring, the control unit 10 performs injection amount calculation processing P10 to calculate an actual injection amount Q3, which is an estimated value of the amount of fuel actually injected by the injector 14, from the monitoring drive pulse input therein from the injector drive circuit 11. The actual injection amount Q3 is calculated in consideration of a fuel injection period of the injector 14, which is learned from the monitoring drive pulse, and a pressure of the fuel supplied to the injector 14. The control unit 10 executes the injection amount calculation processing P10 as fixed angle interrupt processing.

Furthermore, as the processing relating to the drive function monitoring, the control unit 10 performs drive function abnormality determination processing P11 to determine whether or not an abnormality exists in the drive function from a result of a comparison between the actual injection amount Q3 calculated during the injection amount calculation processing P10 and the control required injection amount Q1 calculated during the control required injection amount calculation processing P2. The control unit 10 executes the drive function abnormality determination processing P11 as fixed angle interrupt processing.

Figure 2:
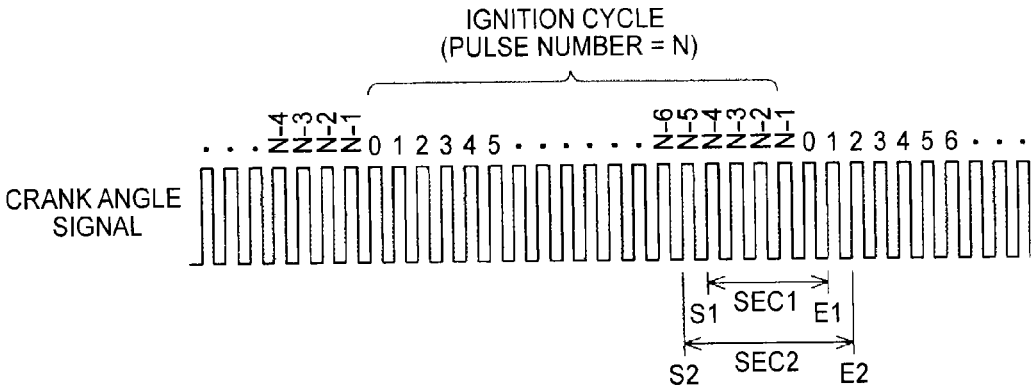
FIG. 2 is a view showing a manner in which the engine control apparatus according to this embodiment sets time measurement sections used to calculate a control rotation speed and a monitoring rotation speed.

Next, a difference in the calculation logic used to calculate the engine rotation speed respectively during the control rotation speed calculation processing P1 and the monitoring rotation speed calculation processing P6 will be described. FIG. 2 shows a crank angle signal obtained by performing waveform shaping on the detection signal of the crank angle sensor 12. As shown in the drawing, the crank angle signal is a pulse signal that rises and falls repeatedly at fixed crank angle intervals.

In the engine control apparatus according to this embodiment, an ignition cycle of the engine is used as a single cycle, and numbers (crank numbers) are appended to pulse rise positions of the crank angle signal in sequence from compression top dead center of each cylinder. Note that in the crank angle signal shown in the drawing, N pulses exist in each ignition cycle of the engine. The crank number in the pulse rise position corresponding to compression top dead center of each cylinder is set at "0", whereupon crank numbers are appended respectively to subsequent pulse rise positions in order of "1", "2", "3", . . . , "N−2", "N−1".

Meanwhile, the engine rotation speed increases in response to combustion following ignition and decreases in response to convergence thereof, with the result that the engine rotation speed fluctuates repeatedly within each ignition cycle. The control rotation speed NE1 and the monitoring rotation speed NE2 are each calculated from a measurement result of a period extending from a start point to an end point of a measurement section that is set as a section having a fixed crank angle width, a timing at which the fluctuation in the engine rotation speed reaches a peak being located substantially centrally within the section.

However, the measurement sections used respectively to calculate the control rotation speed NE1 and the monitoring rotation speed NE2 have different crank angle widths. In the example shown in the drawing, the measurement section (referred to hereafter as an NE1 calculation measurement section SEC1) of the period in which to calculate the control rotation speed NE1 is set such that a start position S1 thereof corresponds to the pulse rise position of the crank angle signal having the crank number "N−4" and an end position E1 thereof corresponds to the pulse rise position having the crank number "1". Further, the measurement section (referred to hereafter as an NE2 calculation measurement section SEC2) used to calculate the monitoring rotation speed NE2 is set such that a start position S2 thereof corresponds to the pulse rise position of the crank angle signal having the crank number "N−5" and an end position E2 thereof corresponds to the pulse rise position having the crank number "2". Hence, in the engine control apparatus according to this embodiment, the monitoring rotation speed NE2 is calculated separately to the control rotation speed NE1 using a detection result obtained by the crank angle sensor 12 at a different timing to a timing used to calculate the control rotation speed NE1.

Next, processing performed by the engine control apparatus according to this embodiment in relation to calculation of the control required injection amount Q1 will be described in detail. The control required injection amount Q1 is calculated through processing of a control required injection amount calculation routine that is executed by the control unit 10 as fixed angle interrupt processing.

Figure 3:
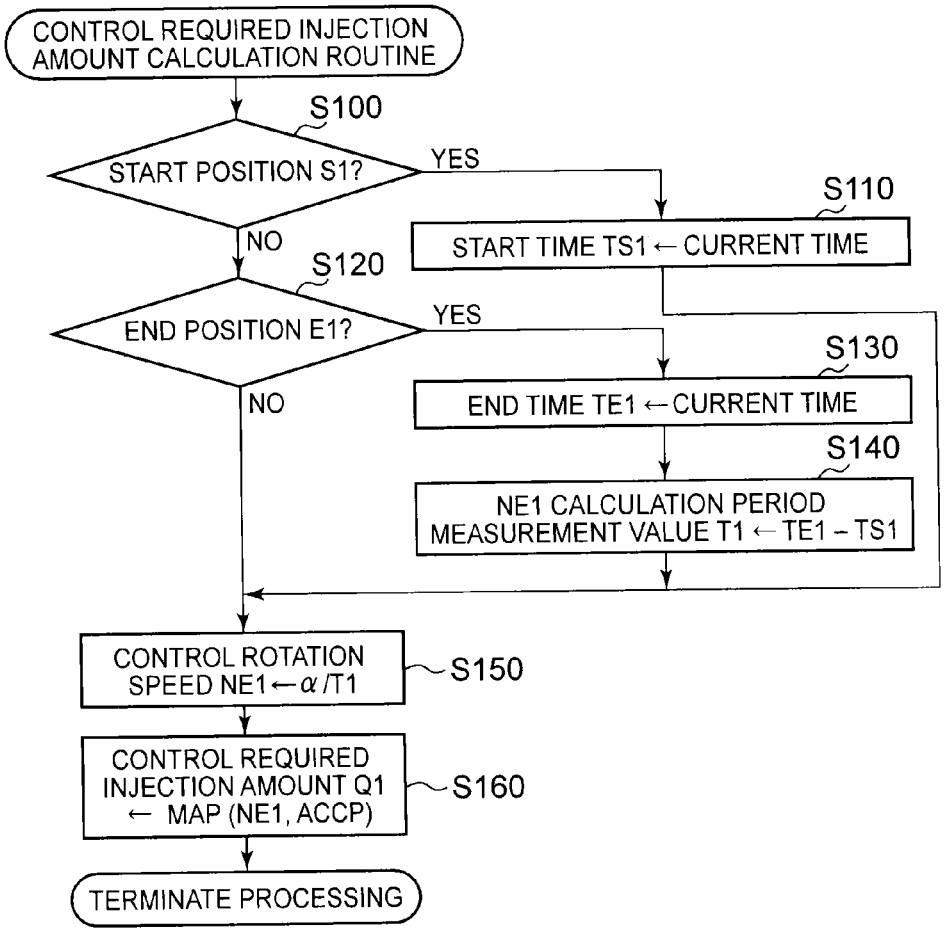
FIG. 3 is a flowchart showing processing procedures of a control required injection amount calculation routine executed by the engine control apparatus according to this embodiment.

FIG. 3 is a flowchart showing the control required injection amount calculation routine. The control unit 10 executes the processing of this routine in each pulse rise position of the crank angle signal.

In step S100 of the routine, a determination is made on the basis of the crank angle number as to whether or not the current pulse rise position of the crank angle signal corresponds to the start position S1 of the NE1 calculation measurement section SEC1. When the current pulse rise position corresponds to the start position S1 of the NE1 calculation measurement section SEC1 (S100: YES), a value of a start time TS1 of the measurement section SEC1, this value being stored in the RAM, is updated to the current time, which is obtained from the aforementioned timer, in step S110. Note that values stored in the RAM will be referred to hereafter as RAM values.

In step S120 of the routine, a determination is made as to whether or not the current pulse rise position corresponds to the end position E1 of the NE1 calculation measurement section SEC1. When the current pulse rise position corresponds to the end position E1 of the measurement section SEC1 (S120: YES), processing of steps S130 and S140 is performed, whereupon the processing advances to step S150. Otherwise (S120: NO) the processing advances as is to step S150.

In step S130, the RAM value of an end time TE1 of the NE1 calculation measurement section SEC1 is updated to the current time obtained from the timer. Next, in step S140, a period (an NE1 calculation period measurement value T1) extending from the start to the end of the NE1 calculation measurement section SEC1 is determined from the RAM values of the start time TS1 and the end time TE1, and stored in the RAM.

When the processing advances to step S150, meanwhile, the control rotation speed NE1 is calculated from the RAM value of the NE1 calculation period measurement value T1 and stored in the RAM in step S150. The control rotation speed NE1 is calculated by dividing a prescribed constant $\alpha$ by the NE1 calculation period measurement value T1. The processing of step S150 corresponds to the control rotation speed calculation processing P1.

Next, in step S160, the control required injection amount Q1 is calculated from the RAM value of the control rotation speed NE1 and a current value of the accelerator depression amount ACCP detected by the accelerator pedal sensor 13, and stored in the RAM. The processing of step S160 corresponds to the control required injection amount calculation processing P2. The control required injection amount Q1 is calculated by referring to a calculation map expressing a correspondence relationship between the required injection amount and the engine rotation speed and accelerator depression amount, the calculation map being stored in the ROM, using the RAM value of the control rotation speed NE1 and the current value of the accelerator depression amount ACCP as parameters.

Next, processing relating to the calculation function monitoring that is performed to monitor the control unit 10 for an abnormality in the calculation function used to calculate the control required injection amount Q1 will be described in detail. The calculation function monitoring is performed through a monitoring rotation speed calculation routine executed by the control unit 10 as fixed angle interrupt processing and a calculation function abnormality determination routine executed by the control unit 10 as fixed time interrupt processing.

Figure 4:
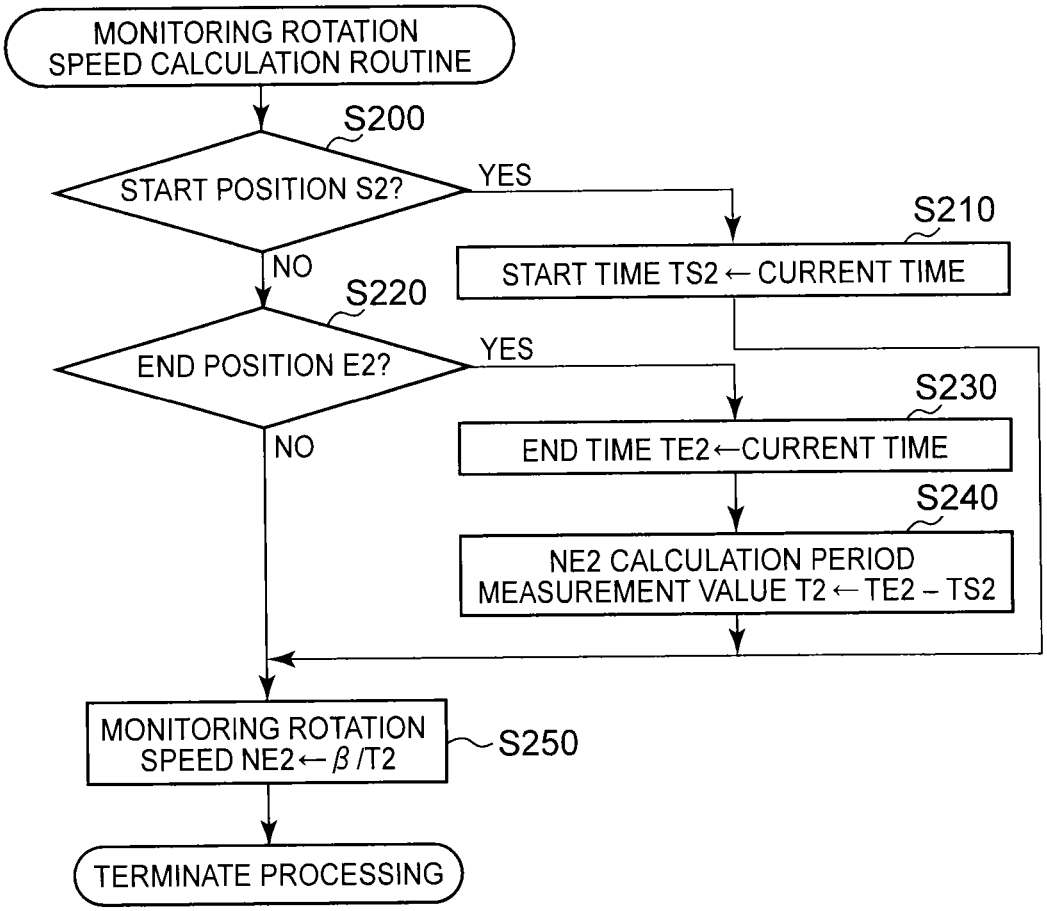
FIG. 4 is a flowchart showing processing procedures of a monitoring rotation speed calculation routine executed by the engine control apparatus according to this embodiment.

FIG. 4 is a flowchart showing the monitoring rotation speed calculation routine. Similarly to the control required injection amount calculation routine described above, the control unit 10 executes the processing of this routine every time the crank angle signal rises.

In step S200 of the routine, a determination is made on the basis of the crank angle number as to whether or not the current pulse rise position of the crank angle signal corresponds to the start position S2 of the NE2 calculation measurement section SEC2. When the current pulse rise position corresponds to the start position S2 of the NE2 calculation measurement section SEC2 (S200: YES), the RAM value of a start time TS2 of the measurement section SEC2 is updated to the current time obtained from the timer in step S210.

In step S220 of the routine, a determination is made as to whether or not the current rise position of the crank angle signal corresponds to the end position E2 of the NE2 calculation measurement section SEC2. When the current rise position of the crank angle signal corresponds to the end position E2 of the measurement section SEC2 (S220: YES), processing of steps S230 and S240 is performed, whereupon the processing advances to step S250. Otherwise (S220: NO) the processing advances as is to step S250.

First, in step S230, the RAM value of an end time TE2 of the measurement section SEC2 is updated to the current time obtained from the timer. Next, in step S240, a period (an NE2 calculation period measurement value T2) extending from the start to the end of the NE2 calculation measurement section SEC2 is determined from the RAM values of the start time TS2 and the end time TE2, and stored in the RAM.

When the processing advances to step S250, meanwhile, the monitoring rotation speed NE2 is calculated from the NE2 calculation period measurement value T2, which is stored in the RAM, and stored in the RAM in step S250. The monitoring rotation speed NE2 is calculated by dividing a prescribed constant β by the NE2 calculation period measurement value T2. The processing of step S250 corresponds to the monitoring rotation speed calculation processing P6.

Figure 5:
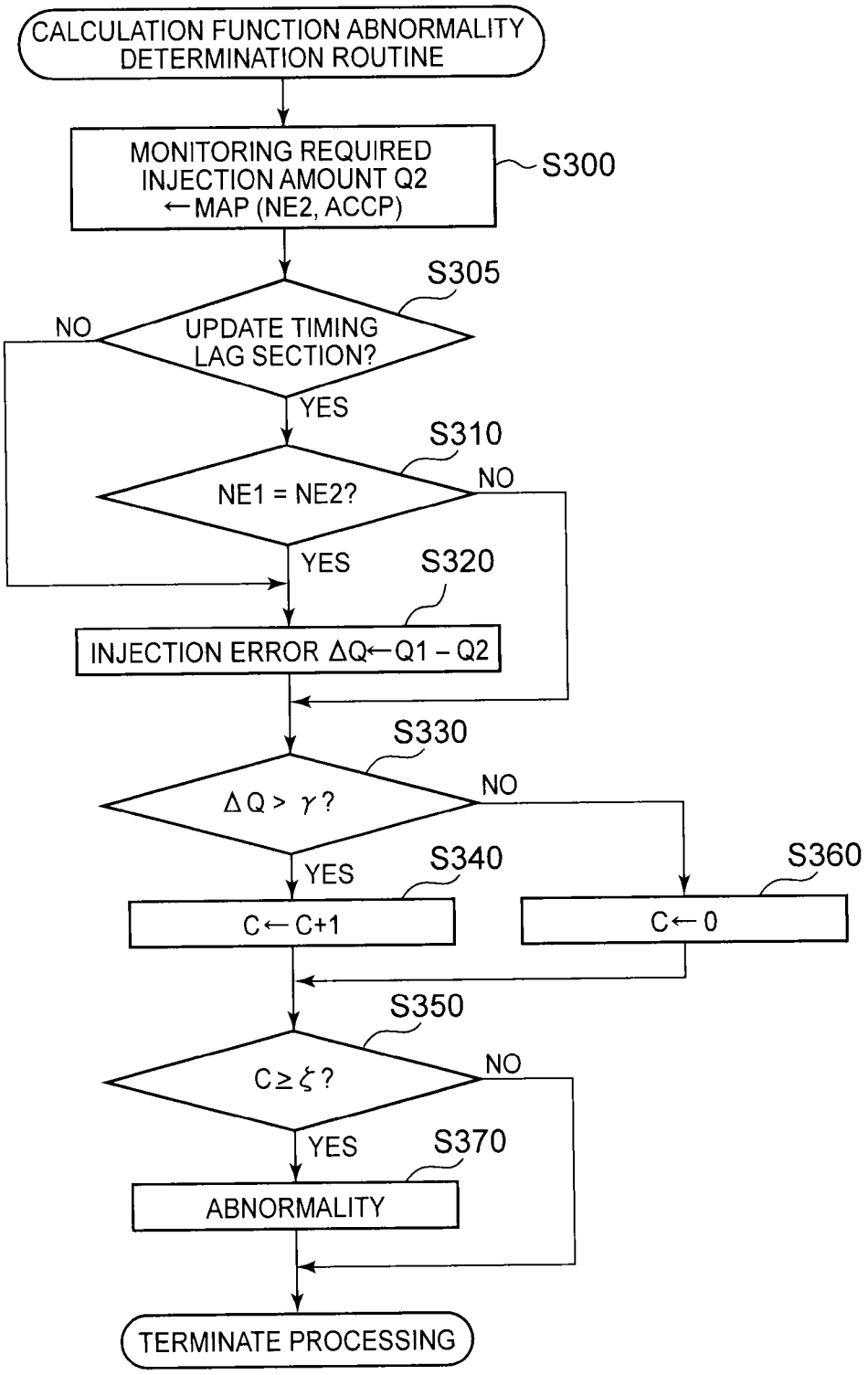
FIG. 5 is a flowchart showing processing procedures of a calculation function abnormality determination routine executed by the engine control apparatus according to this embodiment.

FIG. 5 is a flowchart showing a calculation function abnormality determination routine. The control unit 10 executes processing of this routine at prescribed time intervals. When the routine is started, first, in step S300, the monitoring required injection amount Q2 is calculated from the RAM value of the monitoring rotation speed NE2 and the current value of the accelerator depression amount ACCP, and stored in the RAM. The monitoring required injection amount Q2 is calculated using an identical calculation map to the calculation map used to calculate the control required injection amount Q1 by referring to the calculation map using the RAM value of the monitoring rotation speed NE2 and the current value of the accelerator depression amount ACCP as parameters. The processing of step S300 corresponds to the monitoring required injection amount calculation processing P7.

In step S305, a determination is made on the basis of the crank number as to whether or not the current pulse rise position of the crank angle signal is within a lag section between respective update timings of the RAM values of the control rotation speed NE1 and the monitoring rotation speed NE2, or in other words a section between the end position E1 and the end position E2. In other words, here, a determination is made as to whether or not a lag period between updating of the value of the control rotation speed NE1 and updating of the value of the monitoring rotation speed NE2, which occurs due to a difference between the detection timings of the crank angle sensor 12 used in the calculation, is currently underway.

When the current pulse rise position is not within the lag period (S305: NO), the processing advances to step S320, and in step S320, a difference between the control required injection amount Q1 and the monitoring required injection amount Q2 is determined as an injection amount error ΔQ. Next, in step S330, a determination is made as to whether or not the RAM value of the injection amount error ΔQ exceeds a prescribed determination value γ. When a value of the injection amount error ΔQ is large, this means that the difference between the control required injection amount Q1 and the monitoring required injection amount Q2 is large. In other words, here, the control required injection amount Q1 and the monitoring required injection amount Q2 are compared.

When the value of the injection amount error ΔQ is equal to or smaller than the prescribed determination value γ (S330: NO), or in other words when the difference between the respective values of the control required injection amount Q1 and the monitoring required injection amount Q2 is small, a value of a counter C that expresses a duration of a condition in which the difference is large is cleared to "0" in step S360. When, on the other hand, the value of the injection amount error ΔQ exceeds the prescribed determination value γ (S330: YES), or in other words when the difference between the respective values of the control required injection amount Q1 and the monitoring required injection amount Q2 is large, the value of the counter C is incremented in step S340.

Next, in step S350, a determination is made as to whether or not the value of the counter C equals or exceeds a prescribed determination value ξ. When the value of the counter C is smaller than the determination value ξ (S350: NO), the processing of the current routine is terminated as is. When, on the other hand, the value of the counter C equals or exceeds the determination value ξ (S350: YES), or in other words when the difference between the respective values of the control required injection amount Q1 and the monitoring required injection amount Q2 has remained large continuously for at least a fixed period, the calculation function of the control unit 10 is determined to be abnormal in step S370, whereupon the processing of the current routine is terminated.

When the current pulse rise position is determined to be within the aforesaid lag section in step S305 (S305: YES), on the other hand, the processing advances to step S310, and in step S310, a determination is made as to whether or not the respective values of the control rotation speed NE1 and the monitoring rotation speed NE2 match. When the two values match (S310: YES), the processing advances to S320. In this case, similarly to a case in which a negative determination (NO) is obtained in step S305, the comparison result of (the difference between) the control required injection amount Q1 and the monitoring required injection amount Q2 at the time is used to determine the presence of an abnormality.

When the respective values of the control rotation speed NE1 and the monitoring rotation speed NE2 do not match (S310: NO), on the other hand, the processing of step S320 is skipped, and the processing advances to step S330. In other words, in this case, the RAM value of the injection amount error ΔQ is not updated, and a previous value is maintained as the RAM value. At this time, therefore, the determination of step S330, or in other words the comparison between the control required injection amount Q1 and the monitoring required injection amount Q2, is performed on the basis of respective values of the control rotation speed NE1 and the monitoring rotation speed NE2 obtained before the values became mismatched. Hence, when the values of the engine rotation speeds used respectively to calculate the control required injection amount Q1 and the monitoring required injection amount Q2 do not match, the result of the comparison of the values is not used to determine the presence of an abnormality.

Incidentally, in this routine, an abnormality is determined to exist when the value of the injection amount error ΔQ, which is determined by subtracting the monitoring required injection amount Q2 from the control required injection amount Q1, exceeds the determination value γ continuously for at least the fixed period. In other words, here, an abnormality that causes the fuel injection amount of the engine to become excessive is detected. An abnormality that causes the fuel injection amount of the engine to become too small, on the other hand, is not detected since this type of abnormality is not considered urgent.

Next, actions of the engine control apparatus according to this embodiment will be described. When an abnormality occurs in the calculation function of the control unit 10, the control required injection amount Q1 used during the fuel injection amount control takes an abnormal value such that the amount of fuel injected into the engine becomes inappropriate. In this case, the abnormality can be detected to a certain extent by calculating the monitoring required injection amount Q2 separately to the control required injection amount Q1 and comparing the value thereof with the control required injection amount Q1.

However, the calculated value of the engine rotation speed may also take an abnormal value due to a breakdown in the crank angle sensor 12, a waveform shaping circuit that implements waveform shaping on the detection signal thereof, and so on. At this time, the breakdown is highly unlikely to affect the respective calculation results of the control rotation speed NE1 and the monitoring rotation speed NE2, which are calculated respectively from detection results obtained by the crank angle sensor 12 at different timings, in an identical manner. Hence, likewise when this type of breakdown occurs, a difference appears between the respective values of the control rotation speed NE1 and the monitoring rotation speed NE2, and accordingly between the respective values of the control required injection amount Q1 and the monitoring required injection amount Q2. Under normal circumstances, therefore, a breakdown of this type can also be detected from the result of the comparison between the respective values of the control required injection amount Q1 and the monitoring required injection amount Q2.

Even when this type of abnormality occurs, however, the engine rotation speed values used to calculate the control required injection amount Q1 and the monitoring required injection amount Q2 may be perfectly identical, and in this case, the abnormality affects the calculation results of the two values in an identical manner such that a difference does not appear between the two values. As a result, the abnormality cannot be detected.

Hence, in this embodiment, the control rotation speed NE1 used to calculate the control required injection amount Q1 and the monitoring rotation speed NE2 used to calculate the monitoring required injection amount Q2 are calculated individually on the basis of detection results obtained by the crank angle sensor 12 at different timings within the ignition cycle of the engine. As a result, the control required injection amount Q1 and the monitoring required injection amount Q2 exhibit increased independence, leading to an improvement in the precision with which an abnormality is detected.

Note that in this embodiment, the control required injection amount Q1 is calculated at prescribed crank angle intervals while the monitoring required injection amount Q2 is calculated at prescribed time intervals, and therefore the respective calculation timings of the two amounts are not synchronized. Depending on the timing at which the two amounts are compared, therefore, the presence of an abnormality may be determined on the basis of the comparison result between the control required injection amount Q1 and the monitoring required injection amount Q2 after calculating the control required injection amount Q1 and the monitoring required injection amount Q2 using detection results obtained by the crank angle sensor 12 in different ignition cycles. When the engine rotation speed varies between the ignition cycles, a difference may occur between the engine rotation speed values used respectively to calculate the control required injection amount Q1 and the monitoring required injection amount Q2. As a result, a difference may appear between the respective values of the control required injection amount Q1 and the monitoring required injection amount Q2 such that an abnormality is diagnosed erroneously even though no abnormality exists.

Figure 6:
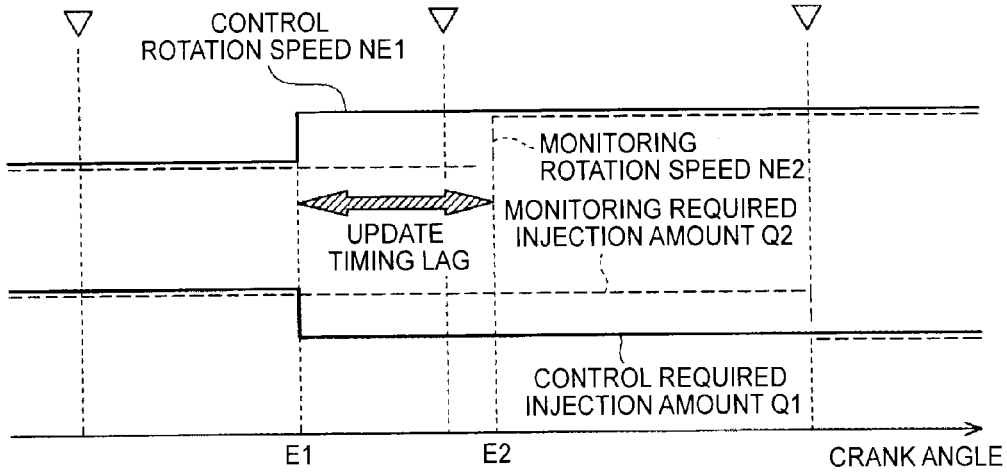
FIG. 6 is a time chart showing transitions of the control and monitoring rotation speeds and the control and monitoring required injection amounts in the engine control apparatus according to this embodiment.

FIG. 6 shows examples of respective transitions of the control rotation speed NE1, the monitoring rotation speed NE2, the control required injection amount Q1, and the monitoring required injection amount Q2. Further, timings at which the monitoring required injection amount Q2 is calculated and the control required injection amount Q1 and monitoring required injection amount Q2 are compared in order to determine the presence of an abnormality are indicated in the drawing by triangles.

As shown in the drawing, a period measurement result obtained in relation to the NE1 calculation measurement section SEC1 is reflected in the RAM value of the control rotation speed NE1 (i.e. the RAM value is updated) in the end position E1 of the measurement section SEC1, and a period measurement result obtained in relation to the NE2 calculation measurement section SEC2 is reflected in the RAM value of the monitoring rotation speed NE2 (i.e. the RAM value is updated) in the end position E2 of the measurement section SEC2. As described above, the end position E1 and the end position E2 are set at different crank numbers, and therefore a lag exists between the respective update timings of the RAM values of the control rotation speed NE1 and the monitoring rotation speed NE2.

Meanwhile, the comparison between the control required injection amount Q1 and the monitoring required injection amount Q2 for determining an abnormality is performed as time interrupt processing. Depending on the timing, therefore, the comparison may be executed within the lag period between the respective update timings of the RAM values of the control rotation speed NE1 and the monitoring rotation speed NE2.

In this case, the value of the control required injection amount Q1 calculated on the basis of a detection result obtained by the crank angle sensor 12 in a most recent ignition cycle is compared with the value of the monitoring required injection amount Q2 calculated on the basis of a detection result obtained by the crank angle sensor 12 in an immediately preceding ignition cycle. Therefore, when the engine rotation speed varies between the ignition cycles, a difference may occur between the respective values of the control rotation speed NE1 and the monitoring rotation speed NE2, and accordingly between the respective values of the control required injection amount Q1 and the monitoring required injection amount Q2 calculated on the basis thereof, with the result that an abnormality is detected erroneously even though no abnormality exists.

Hence, in this embodiment, a determination is made as to whether or not the lag period between the respective update timings of the RAM values of the control rotation speed NE1 and the monitoring rotation speed NE2 is underway before determining the presence of an abnormality on the basis of the comparison result between the control required injection amount Q1 and the monitoring required injection amount Q2. When the lag period is underway and the respective values of the control rotation speed NE1 and the monitoring rotation speed NE2 do not match, the presence of an abnormality is determined without using the comparison result between the control required injection amount Q1 and the monitoring required injection amount Q2 calculated from the mismatched values. With the engine control apparatus according to this embodiment, therefore, erroneous detection of an abnormality due to a deviation between the timings at which the detection results used in the calculation are obtained from the crank angle sensor 12 is suppressed.

With the engine control apparatus according to this embodiment, as described above, following effects can be obtained. (1) In this embodiment, the control required injection amount Q1 used during the actual control and the monitoring required injection amount Q2 used in the comparison for diagnosing an abnormality are calculated individually from the engine rotation speed and the accelerator depression amount, whereupon the presence of an abnormality is determined on the basis of the comparison result between the two amounts. As a result, the engine control apparatus can monitor its own calculation function for an abnormality.

(2) An abnormality diagnosis is performed separately to the diagnosis described above on the basis of a comparison result between the control required injection amount Q1 and the application period during which the injector drive current is applied by the injector drive circuit 11. Therefore, an abnormality can also be diagnosed in the calculation function of the control unit 10 for calculating the energization period, the injector drive pulse generation function of the control unit 10, and the injector drive current application function of the injector drive circuit 11. Moreover, the two abnormality diagnoses are performed individually, and therefore the location of the abnormality can be specified to a certain extent.

(3) In this embodiment, the control rotation speed NE1 used to calculate the control required injection amount Q1 and the monitoring rotation speed NE2 used to calculate the monitoring required injection amount Q2 are calculated individually on the basis of detection results obtained by the crank angle sensor 12 at different timings within the ignition cycle of the engine. As a result, the control required injection amount Q1 and the monitoring required injection amount Q2 exhibit increased independence, enabling an improvement in the precision with which an abnormality is detected.

(4) In this embodiment, the control rotation speed NE1 and the monitoring rotation speed NE2 are calculated from detection results obtained by the crank angle sensor 12 at different timings. Further, when the control required injection amount Q1 and the monitoring required injection amount Q2 are calculated during the lag period between updating of one of the values of the control rotation speed NE1 and the monitoring rotation speed NE2 and updating of the other value, which occurs due to the difference between the detection timings of the crank angle sensor 12 used in the calculation, the presence of an abnormality is determined without using the comparison result between the control required injection amount Q1 and the monitoring required injection amount Q2. As a result, an abnormality that causes the calculated value of the engine rotation speed to take an abnormal value can be detected while suppressing erroneous detection of an abnormality due to a deviation between the timings at which the detection results of the engine rotation speed are obtained.

(5) In this embodiment, as long as the respective values of the control rotation speed NE1 and the monitoring rotation speed NE2 match, the comparison result between the control required injection amount Q1 and the monitoring required injection amount Q2 calculated from the matching values is used to determine the presence of an abnormality even during the lag period. Hence, as long as the actual engine rotation speed does not vary, erroneous detection of an abnormality due to a deviation between the timings at which the detection results of the engine rotation speed are obtained does not occur even when a lag exists between the update timings of the control rotation speed NE1 and the monitoring rotation speed NE2. In this case, the comparison result between the control required injection amount Q1 and the monitoring required injection amount Q2 can be used to determine the presence of an abnormality even during the time difference period described above, and therefore the determination can essentially be increased in frequency, with the result that an abnormality can be detected earlier and with a higher degree of precision.

Note that the above embodiment may be implemented with following modifications. A modification may be applied such that when the control required injection amount Q1 and the monitoring required injection amount Q2 are calculated during the lag period between the respective update timings of the control rotation speed NE1 and the monitoring rotation speed NE2, the comparison result between the two amounts is not used to determine the presence of an abnormality, regardless of whether or not the respective values of the control rotation speed NE1 and the monitoring rotation speed NE2 match. In other words, the determination processing of step S310 in the calculation function abnormality determination routine shown in FIG. 5 may be omitted. Likewise in this case, the effects described in (1) to (4) can be obtained.

In the above embodiment, only an abnormality that causes the fuel injection amount of the engine to become excessive is detected, but an abnormality that causes the fuel injection amount to become too small may also be detected. For example, an abnormality that causes the fuel injection amount to become too small can be detected by determining whether or not an absolute value of the injection amount error $\Delta Q$ exceeds the determination value $\gamma$ in step S330 of the calculation function abnormality determination routine.

In the above embodiment, an abnormality is determined to exist when the difference between the respective values of the control required injection amount Q1 and the monitoring required injection amount Q2 remains large continuously for at least the fixed period, but the condition for determining the presence of an abnormality on the basis of the control required injection amount Q1 and the monitoring required injection amount Q2 may be modified appropriately. For example, an abnormality may be determined to exist when the difference between the values of the control required injection amount Q1 and the monitoring required injection amount Q2 is determined to be large at least a fixed number of times occurring consecutively or non-consecutively. Alternatively, an abnormality may be determined to exist when the difference between the values is determined to be large only once. Moreover, the presence of an abnormality may be determined in accordance with the frequency of the determination and the size of the difference.

The manner in which the measurement sections SEC1, SEC2 according to the above embodiment are set may be modified appropriately. For example, the measurement sections SEC1, SEC2 may be set such that only the start positions S1, S2 are varied relative to each other or such that only the end positions E1, E2 are varied relative to each other. Further, the measurement sections SEC1, SEC2 may be set to have an identical crank angle width or such that the start positions S1, S2 and end positions E1, E2 thereof are respectively shifted relative to each other by an identical crank angle width.

In the above embodiment, when the respective values of the control rotation speed NE1 and the monitoring rotation speed NE2 do not match, the comparison used in the abnormality determination is performed using the control required injection amount Q1 and the monitoring required injection amount Q2 calculated prior to the mismatch. Instead, however, when a mismatch occurs between the values, the comparison itself and the abnormality determination based on the comparison result may be temporarily suspended until the two values match. Likewise in this case, it is possible to ensure that when the respective values of the control rotation speed NE1 and the monitoring rotation speed NE2 do not match, the comparison result between the control required injection amount Q1 and the monitoring required injection amount Q2 calculated from the mismatching values is not used to determine the presence of an abnormality, and as a result, erroneous detection of an abnormality can be suppressed.

In the above embodiment, as well as monitoring the calculation function of the control unit 10 on the basis of the comparison result between the control required injection amount Q1 and the monitoring required injection amount Q2, the drive function of the injector 14 is monitored on the basis of the monitoring drive pulse output by the injector drive circuit 11. However, monitoring of the drive function may be omitted.

What is claimed is:

1. A control apparatus for an engine, the engine including a sensor, the control apparatus comprising:

a control unit configured to (a) calculate a control rotation speed from a detection result obtained by the sensor, (b) calculate a monitoring rotation speed from a detection result obtained by the sensor, (c) calculate a control required injection amount, the control required injection amount being a required injection amount used during actual fuel injection amount control, the control required injection amount being calculated on the basis of the control rotation speed, (d) calculate a monitoring required injection amount, the monitoring required injection amount being a required injection amount used during monitoring, the monitoring required injection amount being calculated on the basis of the monitoring rotation speed, (e) determine whether or not an abnormality has occurred in a calculation function of the control unit on the basis of a comparison result between the control required injection amount and the monitoring required injection amount, (f) calculate the control rotation speed from a detection result obtained by the sensor at a first timing, (g) calculate the monitoring rotation speed from a detection result obtained by the sensor at a second timing that is different to the first timing, and (h) determine whether or not the abnormality has occurred without using the comparison result when the comparison result is calculated during a predetermined period, the predetermined period being a period of a delay that occurs between updating of one of respective values of the control rotation speed and the monitoring rotation speed and updating of the other value due to a difference between the first timing and the second timing.

2. The control apparatus according to claim 1, wherein the sensor includes a crank angle sensor, and the control unit is configured to calculate the control rotation speed and the monitoring rotation speed in each ignition cycle of the engine from detection results obtained by the crank angle sensor respectively at the first timing and the second timing within the ignition cycle.

3. The control apparatus according to claim 1, wherein the control unit is configured to use the comparison result between the control required injection amount calculated during the predetermined period and the monitoring required injection amount calculated during the predetermined period so as to determine whether or not the abnormality has occurred when the control rotation speed and the monitoring rotation speed match during the predetermined period.

4. The control apparatus according to claim 1, wherein the control unit is configured to calculate the control required injection amount as fixed angle interrupt processing, the fixed angle interrupt processing being processing implemented when a crank angle of the engine reaches a prescribed angle, and calculate the monitoring required injection amount as fixed time interrupt processing, the fixed time interrupt processing being processing implemented every time a prescribed period elapses.

* * * * *